US007263304B2

(12) United States Patent
Hasegawa

(10) Patent No.: US 7,263,304 B2
(45) Date of Patent: Aug. 28, 2007

(54) FIXING APPARATUS AND IMAGE FORMING APPARATUS

(75) Inventor: Satoshi Hasegawa, Tagata-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 222 days.

(21) Appl. No.: 11/041,227

(22) Filed: Jan. 25, 2005

(65) Prior Publication Data

US 2006/0165428 A1 Jul. 27, 2006

(51) Int. Cl.
*G03G 15/20* (2006.01)

(52) U.S. Cl. ..... 399/69; 399/122

(58) Field of Classification Search ..... 399/38, 399/67, 69, 122, 320, 328; 219/616, 216
See application file for complete search history.

(56) References Cited

U.S. PATENT DOCUMENTS

| | | | | |
|---|---|---|---|---|
| 6,856,783 | B2 | 2/2005 | Kikuchi | |
| 6,912,367 | B2 * | 6/2005 | Miura | 399/69 |
| 6,936,800 | B2 * | 8/2005 | Kinouchi et al. | 219/663 |
| 7,102,108 | B2 * | 9/2006 | Kikuchi et al. | 219/619 |

FOREIGN PATENT DOCUMENTS

| | | | |
|---|---|---|---|
| JP | 2000-206813 | A | 7/2000 |
| JP | 2001-312178 | A | 11/2001 |
| JP | 2002-124369 | A | 4/2002 |

* cited by examiner

*Primary Examiner*—Hoan Tran
(74) *Attorney, Agent, or Firm*—Foley and Lardner LLP

(57) ABSTRACT

A signal-processing circuit 94 of a simple structure is provided, which generates an operation control signal and a designation signal in accordance with the temperatures detected by temperature sensors 13, 14. The operation control signal and designation signal output from the signal-processing circuit 94 selectively drive a center coil 4 and side coils 5, 6.

17 Claims, 6 Drawing Sheets

FIXING APPARATUS AND IMAGE FORMING APPARATUS

BACKGROUND OF THE INVENTION

Image forming apparatuses read images from documents, form developer images corresponding to the images read, on paper sheets, and fix the developer images on the paper sheets by means of a fixing apparatus.

In the fixing apparatus, a paper sheet is held between the heat roller and the press roller, and heat and pressure are applied to the paper sheet. The developer image on the paper sheet is thereby fixed.

A center coil and side coils are provided within or outside the heat roller. These coils generate high-frequency magnetic fields when a high-frequency current is supplied to them. From the high-frequency magnetic fields there are generated eddy currents. The eddy currents turn into Joule heat. The Joule heat heats the heat roller.

The center coil performs induction heating on that part of the heat roller that is almost middle in the axial direction of the heat roller (i.e., the direction at right angles to the direction in which the heat roller rotates). The side coils perform induction heating at one end of the heat roller and the other end thereof, respectively.

In the fixing apparatus, the center coil and the side coils are alternately driven. The temperatures of the middle part and end parts of the heat roller are detected. The output of the center coil and the output of the side coils are controlled by means of pulse-width modulation, so that the temperatures detected may remain at a preset value.

It is too much for the control means, such as a CPU, to drive the center coil and the side coils alternately and to control the temperature of the heat roller by performing pulse-width modulation.

BRIEF SUMMARY OF THE INVENTION

The object of an embodiment of this invention is to provide a fixing apparatus and an image forming apparatus, in which simple circuits are used, enabling the control means, such as a CPU, to drive the center coil and the side coils alternately and to control the temperature of the heat roller, without imposing a large working load on the control means.

A fixing apparatus according to this invention comprises:

a heating member which rotates;

a first coil which performs induction heating at a part of the heating member, which is almost middle in a direction that intersects at right angles with a direction in which the heating member rotates;

a second coil which performs induction heating at one end part and other end part of the heating member and extending in the direction that intersects at right angles with the direction in which the heating member rotates;

a first temperature sensor which detects a temperature T1 of the part of the heating member, which is almost middle in the direction that intersects at right angles with the direction in which the heating member rotates;

a second temperature sensor which detects a temperature T2 of one end part or the other end part of the heating member, which extends in the direction that intersects at right angles with the direction in which the heating member rotates;

a signal-processing circuit which generates a signal for allowing each of the coils to operate or inhibiting the same from operating, in accordance with the temperatures detected by the temperature sensors, and a signal for selectively operating each of the coils; and a drive circuit which selectively drives each of the coils, in accordance with the signals generated by the signal-processing circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

[1] An Embodiment of this Invention Will be Described, with Reference to the Accompanying Drawings.

An image forming apparatus according to the invention comprises a scanning unit (i.e., scanning unit 33, described later), a process unit (i.e., process unit 45, described later), and a fixing apparatus (i.e., fixing apparatus 1, described later). The scanning unit optically reads images from documents. The process unit forms develop images corresponding to the images ready by the scanning unit, on paper sheets to which the images will be fixed. The fixing apparatus heats developer images formed on paper sheets, thus fixing them to the paper sheets. The structure of the image forming apparatus is disclosed in application Ser. No. 10/602,920 already filed, and will not be described.

Figure 1:
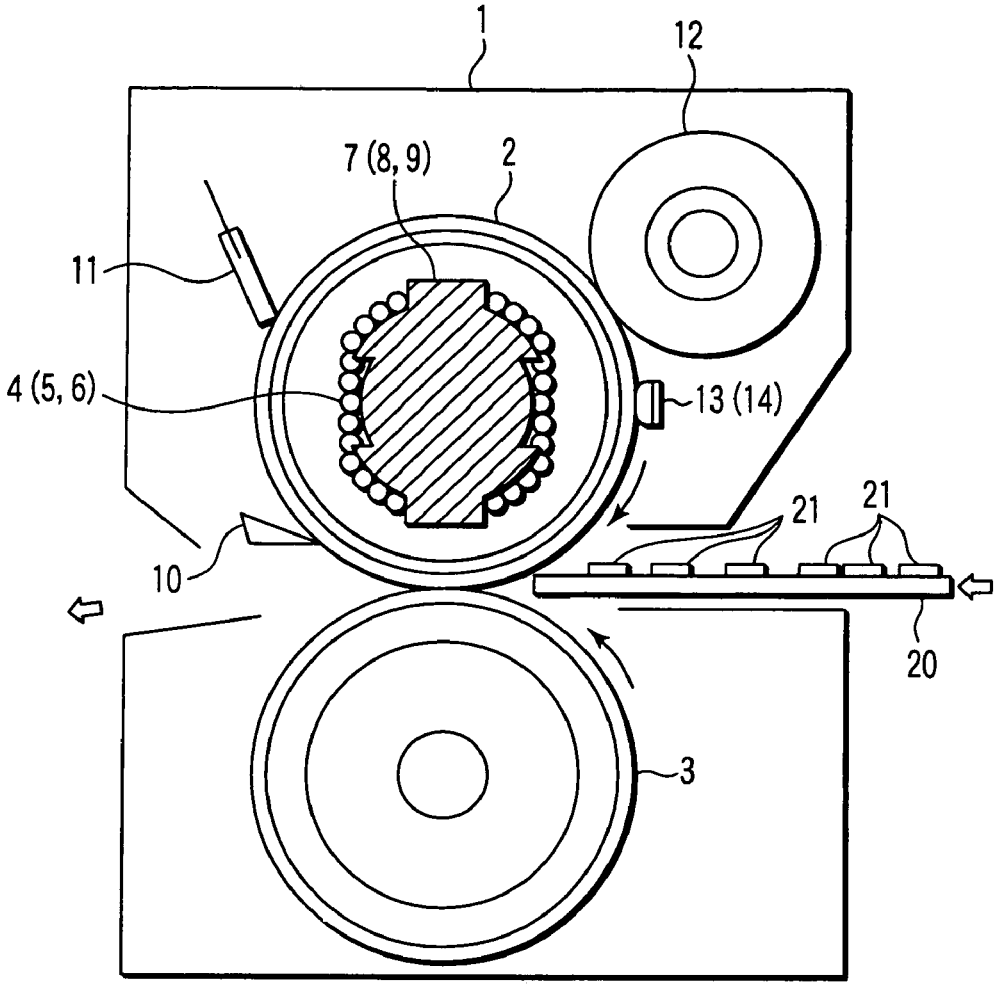
FIG. 1 is a diagram showing the configuration of fixing apparatus that is an embodiment.
Figure 2:
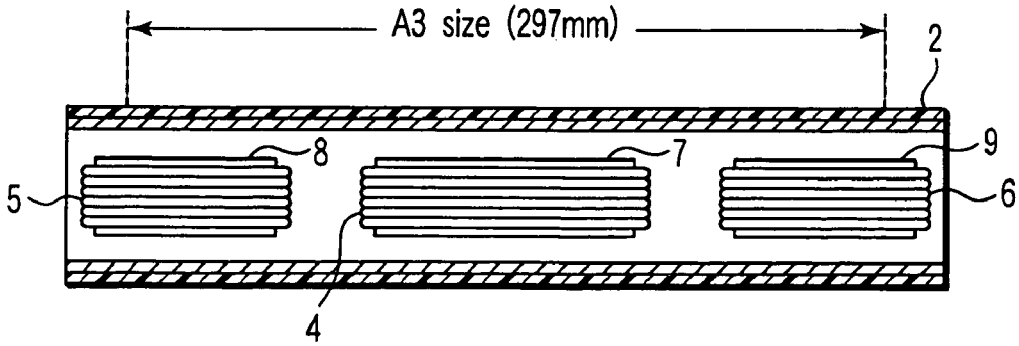
FIG. 2 is a diagram depicting the configuration of the heat roller, coils and cores provided in each embodiment.

FIGS. 1 and 2 show the structure of the fixing apparatus.

The fixing apparatus 1 has a rotary heat member, e.g., a heat roller 2. The heat roller 2 is provided on a press roller 8, i.e., a pressing member, with a paper-transporting path extending between the heat roller 2 and the press roller 8.

The heat roller 2 is located above the paper-transporting path, and the press roller 8 below the path. Through the paper-transporting path, a paper sheet 20 is transported, to which an image will be fixed. The press roller 8 contacts the surface (outer circumferential surface) of the heat roller 2, pressed to the heat roller. It rotates together with the heat roller 2, nipping the paper sheet 20 between it and the heat roller 2, exerting a pressure to the paper sheet 20. While nipped, the paper sheet 20 receives heat from the heat roller 2. The heat melts the developer on the paper sheet 20, fixing the developer image 21 to the paper sheet 20.

The heat roller 2 comprises a metal member and a surface member (a molded layer made of PTFE, PFA or the like) covering the metal member. It is rotated clockwise. The press roller 8 comprises a metal core and a silicon rubber layer or fluororubber layer covering the metal core. It rotates counterclockwise.

The heat roller 2 contains a center coil (first coil) 4 and side coils (second coils) 5 and 6. The center coil 4 is provided in that part of the heat roller 2, which is almost middle in the direction (axial direction) that intersects at right angles with the direction in which the heat roller 2 rotates. The side coil 5 is provided in that part of the heat roller 2, which is one end in the direction that intersects at right angles with the direction in which the heat roller 2 rotates. The side coil 6 is provided in that part of the heat roller 2, which is the other end in the direction that intersects at right angles with the direction in which the heat roller 2 rotates. The side coils 5 and 6 are connected to each other, forming one coil in effect.

These coils 4, 5 and 6 are secured to cores 7, 8 and 9, respectively. They generate high-frequency magnetic fields to accomplish induction heating. When the high-frequency magnetic fields are applied to the heat roller 2, eddy currents flow in the metal member of the heat roller 2. From the eddy currents the metal member generates Joule heat. Thus, the center coil 4 performs induction heating in the middle part of the heat roller 2, and the side coils 5 and 6 carry out induction heating in the end parts of the heat roller 2.

A claw 10, a cleaning member 11, an oil-applying roller 12, and first and second temperature sensors 13 and 14 are arranged around the heat roller 2. The claw 10 is provided to peel a paper sheet 20 from the heat roller 2. The cleaning member 11 is used to remove paper residual developer, paper dust and the like from the heat roller 2. The oil-applying roller 12 applies oil to the surface of the heat roller 2. The first and second temperature sensors 13 and 14 detect the temperatures at the surface of the heat roller 2.

The temperature sensor 13 detects the temperature T1 of that part of the heat roller 2, which is almost middle in the direction (axial direction) that intersects at right angles with the direction in which the heat roller 2 rotates. The temperature sensor 14 detects the temperature T1 of that part of the heat roller 2, which is the other end in the direction (axial direction) that intersects at right angles with the direction in which the heat roller 2 rotates.

The temperature sensors 13 and 14 may either contact-type ones that contact the surface of the heat roller 2 or non-contact type ones that are spaced from the heat roller 2.

Figure 3:
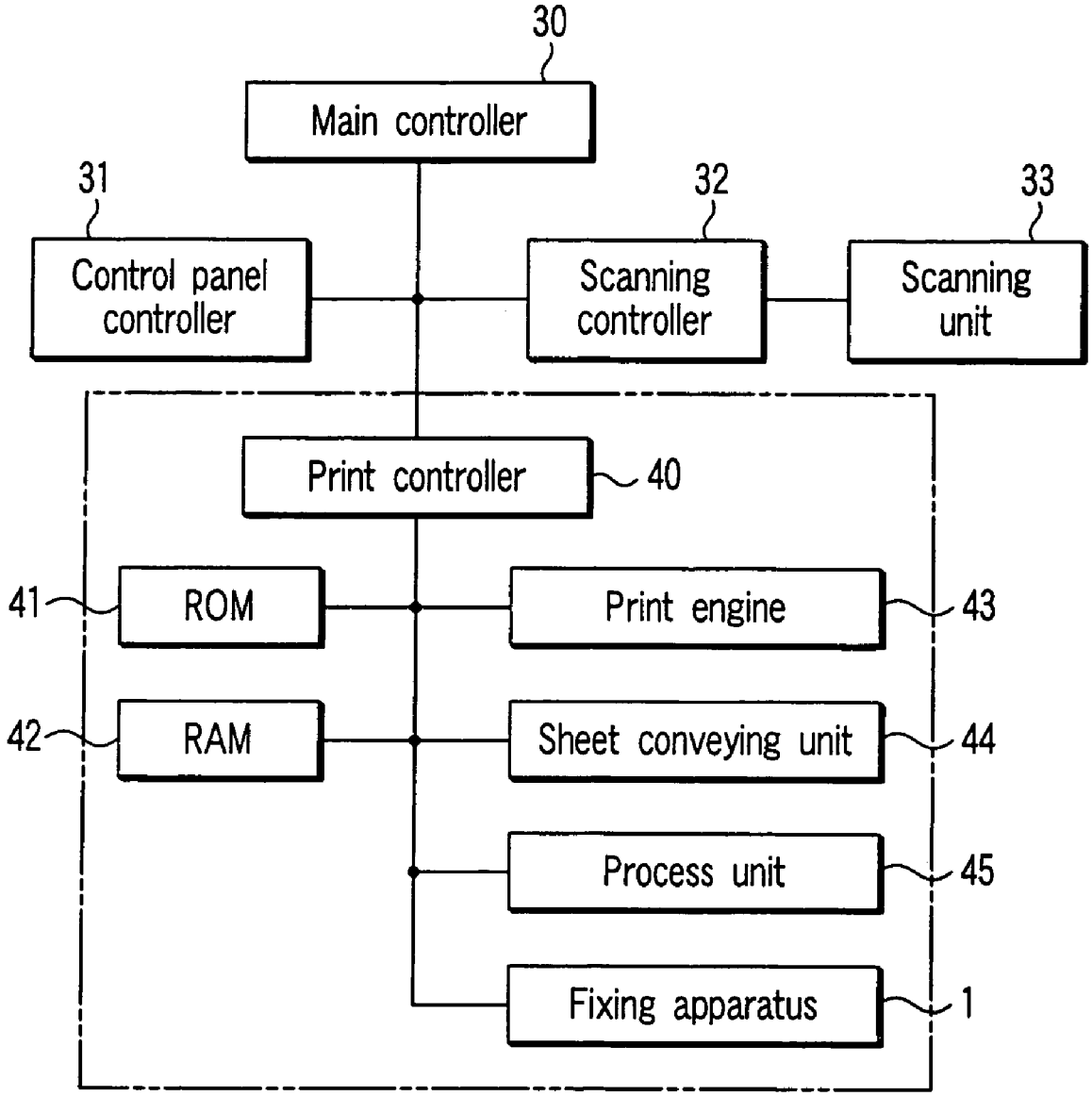
FIG. 3 is a block diagram of the control circuit incorporated in an image forming apparatus that is an embodiment.

FIG. 3 depicts the control circuit incorporated in the image forming apparatus described above.

In the circuit, a control panel controller 31, a scanning controller 32, and a print controller 40 are connected to a main controller 30.

The main controller 30 controls the control panel controller 31, scanning controller 32 and print controller 40. The scanning controller 32 controls the scanning unit 33 that optically reads images from documents.

To the print controller 40 there are connected to a ROM 41, a RAM 42, a print engine 43, a sheet conveying unit 44, the process unit 45 and the fixing apparatus 1. The ROM 41 stores control programs. The RAM is provided to store data. The print engine 43 emits a laser beam, which is applied to the photosensitive drum of the process unit 45 to form an image read by the scanning unit 33, on the photosensitive drum. The sheet conveying unit 44 comprises a mechanism for transporting paper sheets 20 and a drive circuit for driving the mechanism. The process unit 45 uses the laser beam emitted from the print engine 43, forming an electrostatic image on the surface of the photosensitive drum, develops the electrostatic image on the photosensitive drum, using the developer, and transfers the image developed to a paper sheet 20.

Figure 4:
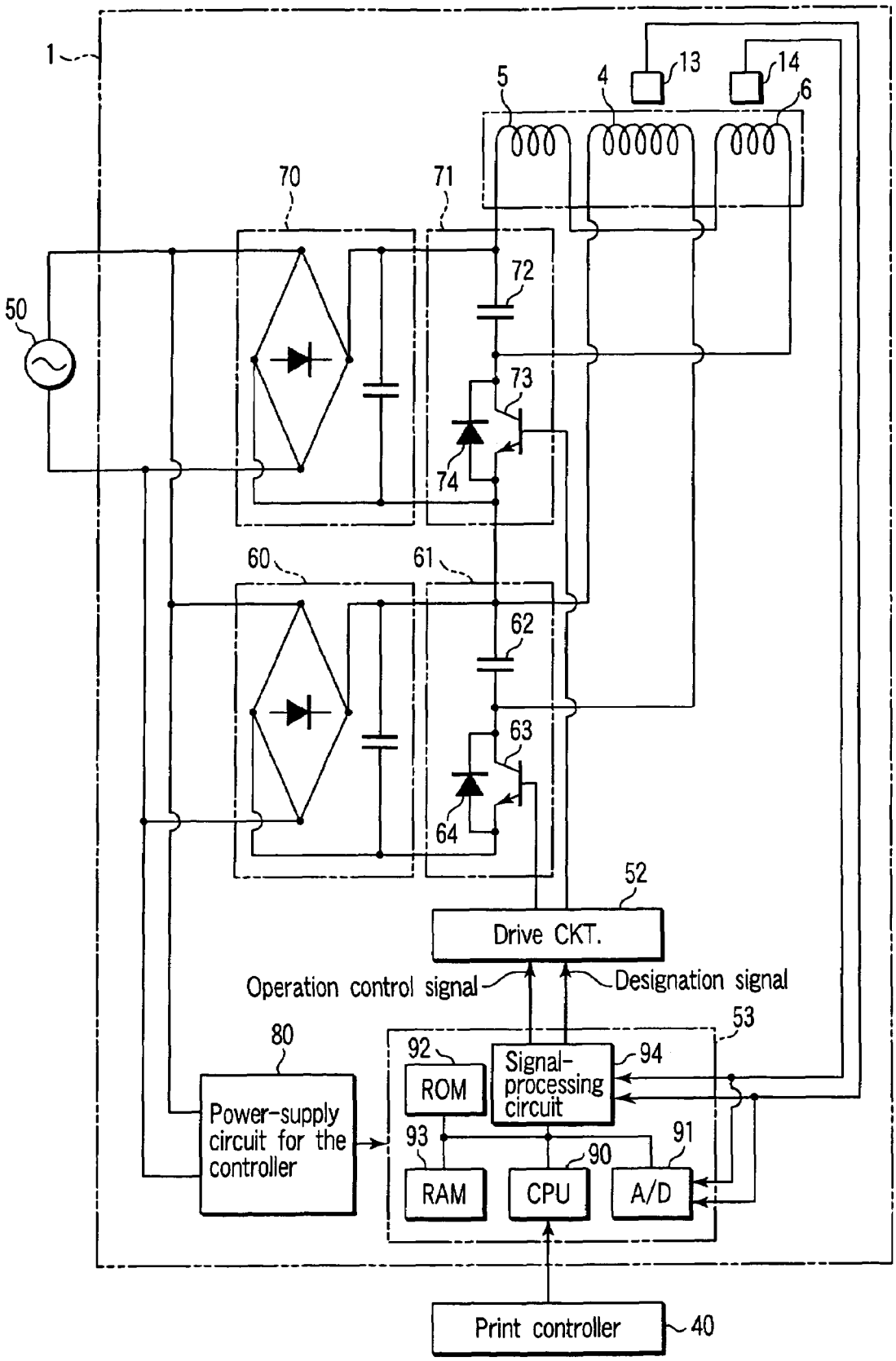
FIG. 4 is a block diagram of the electric circuit provided in a fixing apparatus that is an embodiment.

FIG. 4 illustrates the electric circuit incorporated in the fixing apparatus 1.

In the electric circuit, rectifying circuits 60 and 70 are connected to a commercially available power supply 50. High-frequency wave generating circuits (also called "switching circuits") 61 and 71 are connected to the outputs of the rectifying circuits 60 and 70, respectively.

The high-frequency wave generating circuits 61 comprises a resonance capacitor 62, a switching element, such as a transistor 63, and a damper diode 64. The resonance capacitor 62 constitutes a resonant circuit, jointly with the center coil 4. The transistor 63 excites the resonant circuit. The damper diode 64 is connected in parallel to the transistor 63. When the transistor 63 is repeatedly turned on and off by a drive circuit 52, it generates a high-frequency current.

The high-frequency wave generating circuit 71 comprises a resonance capacitor 72, a switching element, such as a transistor 73, and a damper diode 74. The resonance capacitor 72 constitutes a resonant circuit, jointly with the side coils 5 and 6. The transistor 73 excites the resonant circuit. The damper diode 74 is connected in parallel to the transistor 63. When the transistor 73 is repeatedly turned on and off by a drive circuit 52, it generates a high-frequency current.

The high-frequency wave generating circuits 61 and 71 generate high-frequency currents, which are supplied to the center coil 4 and the side coils 5 and 6. The center coil 4 and the side coils 5 and 6 therefore generate high-frequency magnetic fields. The high-frequency magnetic fields change into eddy currents in the metal member of the heat roller 2. Joule heat is generated from the eddy currents. The metal member is thereby heated.

A power-supply circuit 80 for a controller is connected to the commercially available power supply 50. To the power-supply circuit 80 there is connected a controller 53. The temperature sensors 13 and 14, print controller 40 and drive circuit 52, all mentioned above, are connected to the controller 53.

The controller 53 has a CPU 90, an A/D (analog-to-digital) converting circuit 91, a ROM 92, a RAM 93, and a signal-processing circuit 94. The A/D converting circuit 91 converts the output signals of the temperature sensors 13 and 14 to digital signals. The ROM 92 stores control programs. The RAM 93 is provided to store data.

Figure 5:
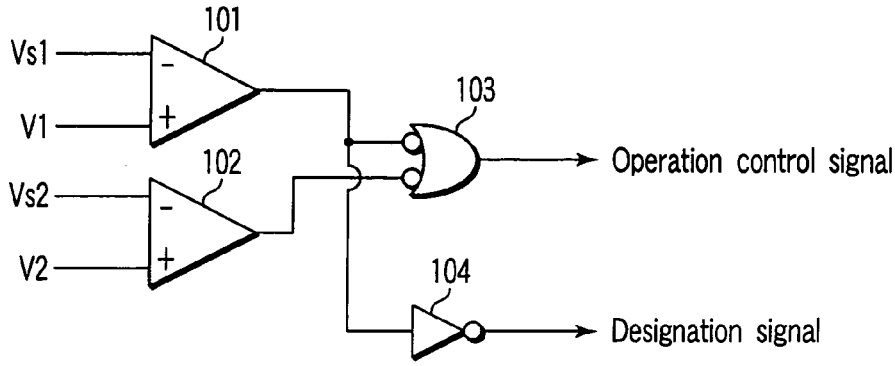
FIG. 5 is a block diagram of the signal-processing circuit used in a first embodiment.

As FIG. 5 shows, the signal-processing circuit 94 comprises a first comparing circuit 101, a second comparing circuit 102, a first gate circuit 103, and a second gate circuit 104.

The first comparing circuit 101 compares voltage V1 with voltage Vs1. The voltage V1 is at a level that corresponds to the temperature T1 detected by the temperature sensor 13.

The voltage Vs1 is at a level that corresponds to a preset temperature Ts1. If V1<Vs1 (T1<Ts1), the circuit 101 outputs a low-level signal. If V1≧Vs1 (T1≧Ts1), the circuit 101 outputs a high-level signal.

The second comparing circuit 102 compares voltage V2 with voltage Vs2. The voltage V2 is at a level that corresponds to the temperature T2 detected by the temperature sensor 14. The voltage Vs2 is at a level that corresponds to a preset temperature Ts2 (=Ts1). If V2<Vs2 (T2<Ts2), the circuit 102 outputs a low-level signal. If V2≧Vs2 (T2≧Ts2), the circuit 102 outputs a high-level signal.

The gate circuit 103 outputs a high-level signal, allowing the coils 4, 5 and 6 to operate, if the output of at least one of the comparing circuits 101 and 102 is a low-level signal. If the outputs of both comparing circuits 101 and 102 are high-level signals, the gate circuit 103 outputs a low-level signal, inhibiting the coils 4, 5 and 6 from operating. The output signal of the gate circuit 103 is supplied, as an operation control signal, to the above-mentioned drive circuit 52.

The gate circuit 104 outputs a high-level signal, designating the operation of the center coil 4, if the output of the comparing circuit 101 is a high-level signal. If the output of the comparing circuit 101 is a low-level signal, the gate circuit 104 outputs a low-level signal, designating the operation of the side coils 5 and 6. The output signal of this gate circuit 103 is supplied, as a designation signal, to the above-mentioned drive circuit 52.

The drive circuit 52 selectively drives the high-frequency wave generating circuits 61 and 71, in accordance with the operation control signal and designation signal supplied from the gate circuits 103 and 104, respectively.

Figure 6:
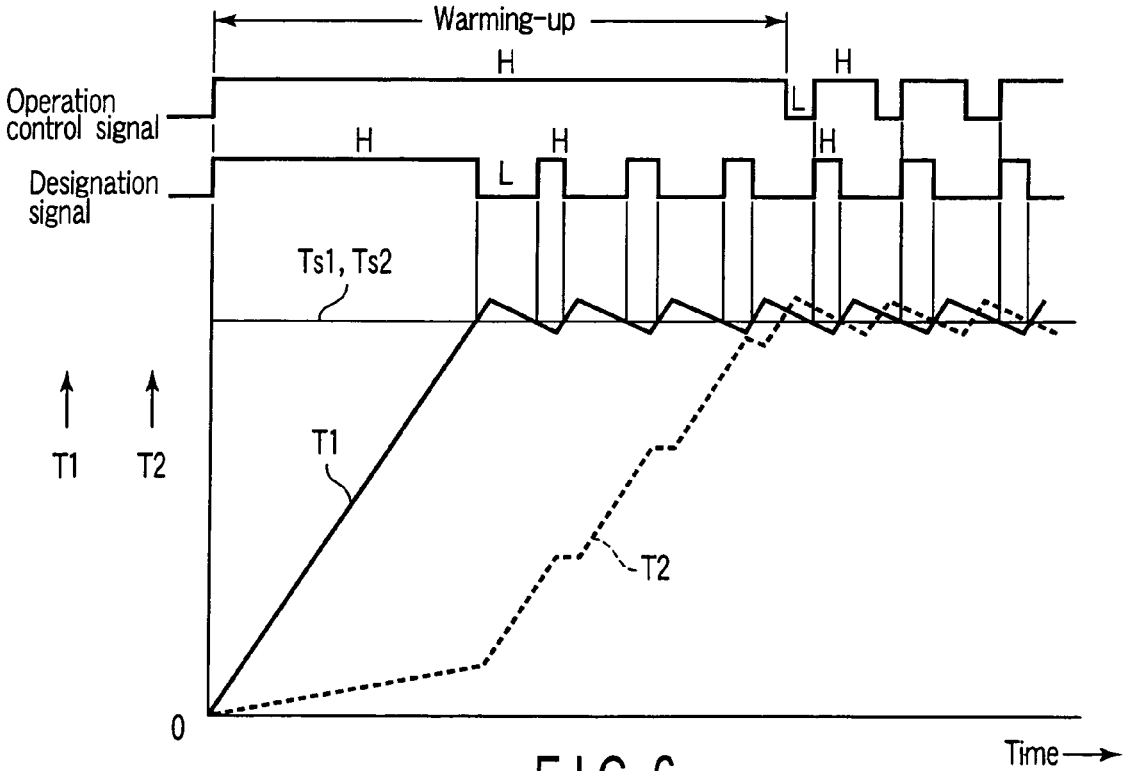
FIG. 6 is a diagram explaining the operation of the signal-processing circuit provided in the first embodiment.

The operation will be explained, with reference to FIG. 6.

When the commercially available power supply 50 is turned on, the temperature sensor 13 detects the temperature T1 of the almost middle part of the heat roller 2. The temperature sensor 14 detects the temperature T2 of the other end part of the heat roller 2.

At first, the temperature T1 detected by the temperature sensor 13 is lower than the set temperature Ts1 (T1<Ts1). The comparing circuit 101 therefore outputs a low-level signal. The temperature T2 detected by the temperature sensor 14 is lower than the set temperature Ts2 (T2<Ts2). The comparing circuit 102 therefore outputs a low-level signal.

If the outputs of the comparing circuits 101 and 102 are low-level signals, the output (operation control signal) of the gate circuit 103 is at high level. Thus, the coils 4, 5 and 6 can operate. If the output of the comparing circuit 101 is a low-level signal, the output (designation signal) is at high level. The operation of the center coil 4 is therefore designated.

When the operation of the center coil 4 is designated while the coils 4, 5 and 6 are allowed to operate, the high-frequency wave generating circuit 61 is driven, and the center coil 4 operates. As the center coil 4 operates, the middle part of the heat roller 2 is heated and the temperature rises. As the temperature rises, so do the temperatures of both end parts of the heat roller 2.

When the temperature T1 detected by the temperature sensor 13 rises to the set temperature Ts1 or a higher temperature (T1≧Ts1), the output of the comparing circuit 101 becomes a high-level signal. When the output of the comparing circuit 101 becomes a high-level signal, the output (designation signal) of the gate circuit 104 becomes a low-level signal. Hence, the operation of the side coils 5 and 6 is designated.

Even if the temperature T1 detected by the temperature sensor 13 rises to or above the set temperature Ts1, the temperature T2 detected by the temperature sensor 14 may remain lower than the set temperature Ts2. In this case, the output of the comparing circuit 102 remains a low-level signal. Hence, the output (operation control signal) of the comparing circuit 102 remains a high-level signal. This allows the coils 4, 5 and 6 to operate.

When the operation of the side coils 5 and 6 is designated while the coils 4, 5 and 6 are allowed to operate, the high-frequency wave generating circuit 71 is driven and the side coils 5 and 6 operate. When the side coils 5 and 6 thus operate, both end parts of the heat roller 2 are heated, emanating heat.

When the temperature T1 detected by the temperature sensor 13 falls below the set temperature Ts1 (T1<Ts1), the output of the comparing circuit 101 becomes a low-level signal. When the output of the comparing circuit 101 becomes a low-level signal, the output (designation signal) of the gate circuit 104 becomes a high-level signal. As a result, the operation of the center 4 is designated.

At this time, the output (operation control signal) of the gate circuit 103 remains at high level. The coils 4, 5 and 6 are therefore allowed to operate.

While the coils 4, 5 and 6 are allowed to operate, the operation of the center coil 4 may be designated again. Then, the high-frequency wave generating circuit 61 is driven, and the center coil 4 operates. The high-frequency wave generating circuit 71 is no longer driven. Thus, the side coils 5 and 6 stop operating. As the center coil 4 so operates, the almost middle part of the heat roller 2 is heated and its temperature rises.

Thereafter, the center coil 4, on the one hand, and the side coils 5 and 6, on the other, alternately operate, on the basis of the output of the comparing circuit 101 that has compared the temperature T1 detected by the temperature sensor 13 with the set temperature Ts1.

The temperature T1 detected by the temperature sensor 13 may rise to or above the set temperature Ts1 (T1≧Ts1), and the temperature T2 detected by the temperature sensor 14 may rise to or above the set temperature Ts2 (T2≧Ts2). Then, the outputs of both comparing circuits 101 and 102 change to a high-level signal. In this case, the output (operation control signal) of the gate circuit 103 becomes a high-level signal. The coils 4, 5 and 6 are therefore inhibited from operating. That is, the high-frequency wave generating circuits 61 and 71 stop operating. All coils 4, 5 and 6 therefore stop operating. Thus, warming-up is terminated.

After the warming-up is terminated, the temperature T1 detected by the temperature sensor 13 falls below the set temperature Ts1 (T1<Ts1). Then, the output of the comparing circuit 101 becomes a low-level signal. The output (operation control signal) of the gate circuit 103 therefore becomes a high-level signal. The coils 4, 5 and 6 are allowed to operate. The output (designation signal) of the gate circuit 104 becomes a high-level signal, which designates the operation of the center coil 4. The center coil 4 therefore operates.

When the temperature T1 detected by the temperature sensor 13 rises to or above the set temperature Ts1 (T1≧Ts1), the output of the comparing circuit 101 becomes a high-level signal. The output (designation signal) of the gate circuit 104 therefore becomes a low-level signal. This signal designates the operation of the side coils 5 and 6. Hence, the side coils 5 and 6 operate.

As the center coil 4, on the one hand, and the side coils 5 and 6, on the other, alternately operate, the temperature T1 of the almost middle part and the temperature T2 of the end parts of the heat roller 2 are maintained at the set temperatures Ts1 and Ts2, respectively.

As can be understood from above, the signal-processing circuit 94 that generates an operation control signal and a designation signal in accordance with the temperatures detected by the temperature sensors 13 and 14 has a simple structure and is therefore inexpensive. The center coil 4 and the side coils 5 and 6 are selected and driven, in accordance with the operation control signal and designation signal supplied from the signal-processing circuit 94. Thus, the center coil 4 and the side coils 5 and 6 are alternately driven and the temperature of the heat roller 2 is controlled, without imposing a load on the CPU 90 and the like. Namely, the use of the signal-processing circuit 94 can reduce the cost, because the circuit 94 is simple and inexpensive.

The set temperatures Ts1 and Ts2 are of the same value. Nonetheless, the set temperatures Ts1 and Ts2 may differ from each other. If the set temperatures Ts1 and Ts2 are different, the temperature distribution will be uniform in the axial direction of the heat roller 2, regardless of the thermal capacity of the heat roller 2 or the size of the paper sheet 20.

A Second Embodiment of this Invention will be Described.

Figure 7:
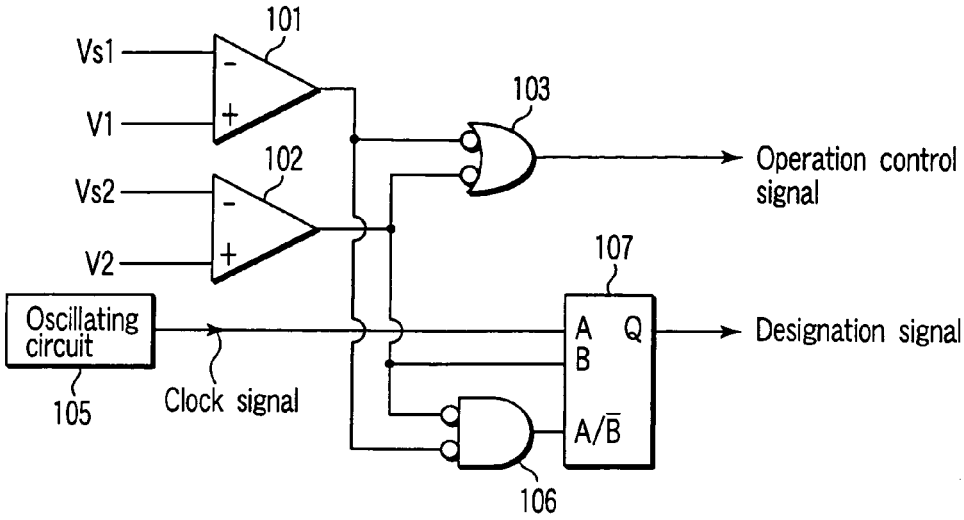
FIG. 7 is a block diagram of the signal-processing circuit used in a second embodiment.

As FIG. 7 depicts, the signal-processing circuit 94 comprises a first comparing circuit 101, a second comparing circuit 102, a first gate circuit 103, an oscillating circuit 105, a second gate circuit 106, and a selecting circuit 107.

The comparing circuit 101 compares voltage V1 with voltage Vs. The voltage V1 is at a level that corresponds to the temperature T1 detected by the temperature sensor 13. The voltage Vs is at a level that corresponds to a preset temperature Ts1. If V1<Vs1 (T1<Ts1), the circuit 101 outputs a low-level signal. If V1≧Vs1 (T1≧Ts1), the circuit 101 outputs a high-level signal.

The comparing circuit 102 compares voltage V2 with voltage Vs2. The voltage V2 is at a level that corresponds to the temperature T2 detected by the temperature sensor 14. The voltage Vs2 is at a level that corresponds to a preset temperature Ts2 (=Ts1). If V2<Vs2 (T2<Ts2), the circuit 102 outputs a low-level signal. If V2≧Vs2 (T2≧Ts2), the circuit 102 outputs a high-level signal.

The gate circuit 103 outputs a high-level signal, allowing the coils 4, 5 and 6 to operate, if the output of at least one of the comparing circuits 101 and 102 is a low-level signal. If the outputs of both comparing circuits 101 and 102 are high-level signals, the gate circuit 103 outputs a low-level signal, inhibiting the coils 4, 5 and 6 from operating. The output signal of the gate circuit 103 is supplied, as an operation control signal, to the above-mentioned drive circuit 52.

The oscillating circuit 105 generates a clock signal that has an on-off duty of, for example, 50%.

The gate circuit 106 outputs a high-level signal for selecting the output signal of the oscillating circuit 105, if the outputs of the comparing circuits 101 and 102 are low-level signals. If neither the output of the comparing circuit 101 nor the output of the comparing circuit 102 is a low-level signal, the gate circuit 106 outputs a low-level signal for selecting the output signal of the comparing circuit 102.

The selecting circuit 107 has a first input terminal A, a second input terminal B, and a third input terminal. The first input terminal A receives the clock signal from the oscillating circuit 105. The second input terminal B receives the output signal of the comparing circuit 102. The third terminal receives the output signal of the gate circuit 106. If the input to the third input terminal is a high-level signal, the circuit 107 selects and outputs the signal input to the first input terminal A (i.e., the output signal of the oscillating circuit 106). If the input (the output signal of the gate circuit 106) to the third input terminal is a low-level signal, the circuit 107 selects and outputs the signal input to the second input terminal B (i.e., the output signal of the comparing circuit 102). The signal output from the circuit 107 is supplied to the above-mentioned drive circuit 52, as a designation signal for operating the center coil 4 or the side coils 5 and 6.

Figure 8:
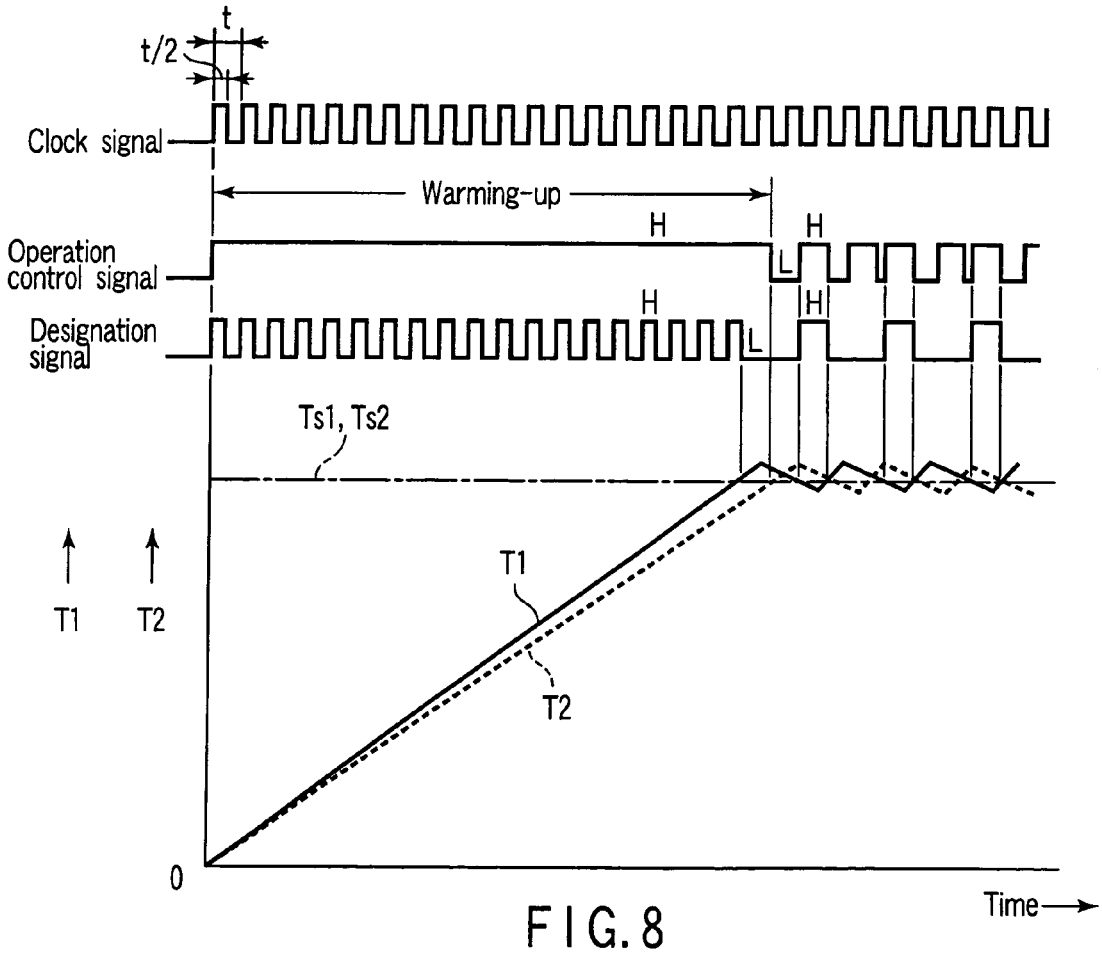
FIG. 8 is a diagram explaining the operation of the signal-processing circuit provided in the second embodiment.

The operation will be explained with reference to FIG. 8.

When a commercially available power supply 50 is turned on, the oscillating circuit 105 generates a clock signal that has an on-off duty of 50%. In other words, the power supply 50 outputs a clock signal having a pulse width of t/2.

At first, the temperature T1 detected by the temperature sensor 13 is lower than the set temperature Ts1 (T1<Ts1). The comparing circuit 101 therefore outputs a low-level signal. The temperature T2 detected by the temperature sensor 14 is also lower than the set temperature Ts2 (T2<Ts2). The comparing circuit 102 therefore outputs a low-level signal.

If the outputs of the comparing circuits 101 and 102 are low-level signals, the output (operation control signal) of the gate circuit 103 is at high level. The coils 4, 5 and 6 are therefore allowed to operate.

If the outputs of both comparing circuits 101 and 102 are low-level signals, the output of the gate circuit 106 becomes a high-level signal. When the output of the gate circuit 106 is a high-level signal, the selecting circuit 107 selects and outputs the clock signal (designation signal) generated by the oscillating circuit 105. If this clock signal is at high level, it designates the operation of the center coil 4. If the clock signal is at low level, it designates the operation of the side coils 5 and 6.

While the coils 4, 5 and 6 are allowed to operate, the operation of the center coil 4 and the operation of the side coils 5 and 6 may be alternately designated. If this is the case, the high-frequency wave generating circuits 61 and 71 are alternately driven. The center coil 4, on the one hand, and the side coils 5 and 6, on the other, alternately operate. The almost middle part of the heat roller 2 and both end parts thereof are heated and the temperature rises.

When the temperature T1 detected by the temperature sensor 13 rises to or above the set temperature Ts1 (T1≧Ts1), the output of the comparing circuit 101 becomes a high-level signal. When the output of the comparing circuit 101 becomes a high-level signal, the output of the gate circuit 106 becomes a low-level signal. The selecting circuit 107 therefore selects and outputs the output signal (designation signal) of the comparing circuit 102.

At this time, the temperature T2 detected by the temperature sensor 14 may be lower than the set temperature Ts2 (T2<Ts2). In this case, the output of the comparing circuit 102 remains a low-level signal. This low-level signal is selected and output as a designation signal, designating the operation of the side coils 5 and 6.

The temperature T1 detected by the temperature sensor 13 may rise to or above the set temperature Ts1, and the output of the comparing circuit 102 may change to a high-level signal. Even if so, the output of the gate circuit 103 (operation control signal) remains a high-level signal. Hence, the coils 4, 5 and 6 are allowed to operate.

When the operation of the side coils 5 and 5 are designated while the side coils are allowed to operate, the high-frequency wave generating circuit 71 is driven, operating the side coils 5 and 6. The high-frequency wave generating circuit 61 is no longer driven, and the center coil 4 stops operating. As the side coils 5 and 6 operate, the end parts of the heat roller 2 are heated, and the temperature thereof rises.

When the temperature T2 detected by the temperature sensor 14 rises to or above the set temperature Ts2 (T2≧Ts2), the output of the comparing circuit 102 becomes a high-level signal. The temperature T1 detected by the temperature sensor 13 has already risen to or above the set temperature Ts1, and the output (operation control signal) of the gate circuit 103 has changed to a low-level signal. Hence, the coils 4, 5 and 6 are inhibited from operating. That is, the high-frequency wave generating circuits 61 and 71 are stopped, irrespective of the output (designating signal) of the selecting circuit 107. The coils 4, 5 and 6 therefore stop operating. Thus, the warming-up is terminated.

After the warming-up is terminated, the temperature T1 detected by the temperature sensor 13 falls below the set temperature Ts1 (T1<Ts1). At this time, the output of the comparing circuit 101 becomes a low-level signal. As a result, the output (operation control signal) of the gate circuit 103 becomes a high-level signal. This allows the coils 4, 5 and 6 to operate. If the temperature T2 detected by the temperature sensor 14 remains equal to or higher than the set temperature Ts2 (T1≧Ts2), the output of the comparing circuit 102 is a high-level signal. The output (designation signal) of the gate circuit 106 remains at low level. The selecting circuit 107 therefore selects and outputs the high-level signal that is the output of the comparing circuit 102. Selected as a designation signal, this high-level signal designates the operation of the center coil 4.

The coils 4, 5 and 6 are allowed to operate, and the operation of the center coil 4 is designated. Thus, the center coil 4 starts operating.

Thereafter, the temperature T2 detected by the temperature sensor 14 falls below the set temperature Ts2 (T1<Ts2). Then, the output of the comparing circuit 102 becomes a low-level signal. The selecting circuit 107 selects and outputs this low-level signal as a designation signal. Thus, the operation of the side coils 5 and 6 is designated.

The coils 4, 5 and 6 are allowed to operate, and the operation of the side coils 5 and 6 is designated. Hence, the side coils 5 and 6 start operating.

The center coil 4 and the side coils 5 and 6 are thus alternately operated. The temperature T1 of the almost middle part of the heat roller 2 and the temperature T2 of the end parts thereof are thereby maintained at the set temperatures Ts1 and Ts2, respectively.

As indicated above, the signal-processing circuit 94 that has a simple structure and is inexpensive generates an operation control signal and a designation signal in accordance with the temperatures detected by the temperature sensors 13 and 14. The operation control signal and the designation signal, both output from the signal-processing circuit 94, selectively drive the center coil 4 and the side coils 5 and 6. This easily accomplishes the alternate driving of the center coil 4 and the side coils 5 and 6 and the temperature control of the heat roller 2, without imposing a load on the control achieved by the CPU 90 and the like. The use of the simple and inexpensive signal-processing circuit 94 can reduce the cost.

As described above, the clock signal the oscillating circuit 105 generates has an on-off duty of 50%. Nonetheless, the on-off duty of the clock signal is not limited to this value. The on-off duty of the clock signal output from the oscillating circuit 105 may be changed to adjust the ratio of the operation of the center coil 4 to the operation of the side coils 5 and 6. If this ratio is adjusted, the temperature can be uniformly distributed in the heat roller 2 in the axial direction thereof, regardless of the thermal capacity of the heat roller 2 or the size of the paper sheet 20.

The set temperatures Ts1 and Ts2 have the same value. Instead, the temperatures Ts1 and Ts2 may be set to different values. Even if the set temperatures Ts1 and Ts2 are different, the temperature can be uniformly distributed in the heat roller 2 in the axial direction thereof, regardless of the thermal capacity of the heat roller 2 or the size of the paper sheet 20.

A Third Embodiment of the Present Invention will be Described.

Figure 9:
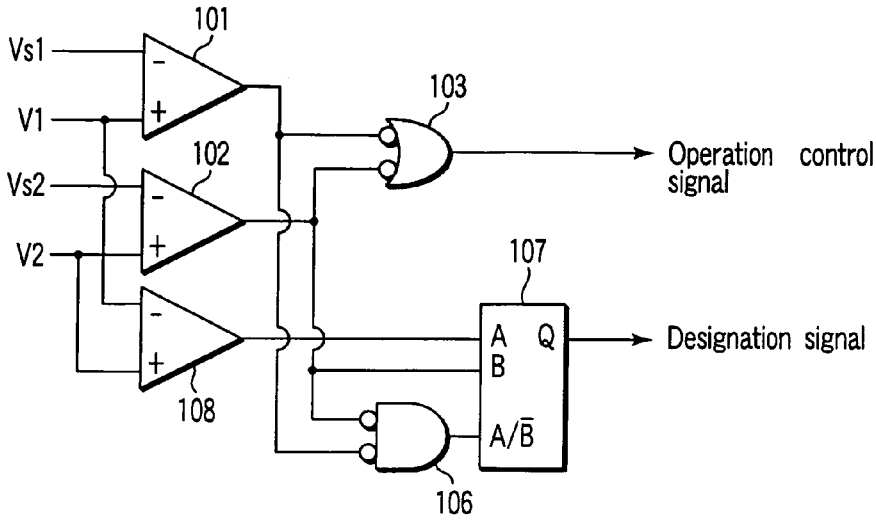
FIG. 9 is a block diagram of the signal-processing circuit incorporated in a third second embodiment.

As FIG. 9 shows, the signal-processing circuit 94 comprises a first comparing circuit 101, a second comparing circuit 102, a first gate circuit 103, a second gate circuit 106, a selecting circuit 107, and a third comparing circuit 108.

The comparing circuit 101 compares voltage V1 with voltage Vs. The voltage V1 is at a level that corresponds to the temperature T1 detected by the temperature sensor 13. The voltage Vs is at a level that corresponds to a preset temperature Ts1. If V1<Vs1 (T1<Ts1), the circuit 101 outputs a low-level signal. If V1≧Vs1 (T1≧Ts1), the circuit 101 outputs a high-level signal.

The comparing circuit 102 compares voltage V2 with voltage Vs2. The voltage V2 is at a level that corresponds to the temperature T2 detected by the temperature sensor 14. The voltage Vs2 is at a level that corresponds to a preset temperature Ts2 (=Ts1). If V2<Vs2 (T2<Ts2), the circuit 102 outputs a low-level signal. If V2≧Vs2 (T2≧Ts2), the circuit 102 outputs a high-level signal.

The gate circuit 103 outputs a high-level signal, allowing the coils 4, 5 and 6 to operate, if the output of at least one of the comparing circuits 101 and 102 is a low-level signal. If the outputs of both comparing circuits 101 and 102 are high-level signals, the gate circuit 103 outputs a low-level signal, inhibiting the coils 4, 5 and 6 from operating. The output signal of the gate circuit 103 is supplied, as an operation control signal, to the above-mentioned drive circuit 52.

The comparing circuit 108 compares the voltage V1 with voltage V2. As pointed out above, the voltage V1 is at a level that corresponds to the temperature T1 detected by the temperature sensor 13. The voltage V2 is at a level that corresponds to the temperature T2 detected by the temperature sensor 14. The comparing circuit 108 outputs a high-level signal or a low-level signal, in accordance with the result of the comparison.

The gate circuit 106 outputs a high-level signal for selecting the output signal of the comparing circuit 108, if the outputs of the comparing circuits 101 and 102 are low-level signals. If neither the output of the comparing circuit 101 nor the output of the comparing circuit 102 is a low-level signal, the gate circuit 106 outputs a low-level signal for selecting the output signal of the comparing circuit 102.

The selecting circuit 107 has a first input terminal A, a second input terminal B, and a third input terminal. The first input terminal A receives the output signal output of the comparing circuit 108. The second input terminal B receives the output signal of the comparing circuit 102. The third terminal receives the output signal of the gate circuit 106. If the input to the third input terminal is a high-level signal, the circuit 107 selects and outputs the signal input to the first input terminal A (i.e., the output signal of the comparing circuit 108). If the input (the output signal of the gate circuit 106) to the third input terminal is a low-level signal, the circuit 107 selects and outputs the signal input to the second input terminal B (i.e., the output signal of the comparing circuit 102). The signal output from the circuit 107 is supplied to the above-mentioned drive circuit 52, as a designation signal for operating the center coil 4 or the side coils 5 and 6.

Figure 10:
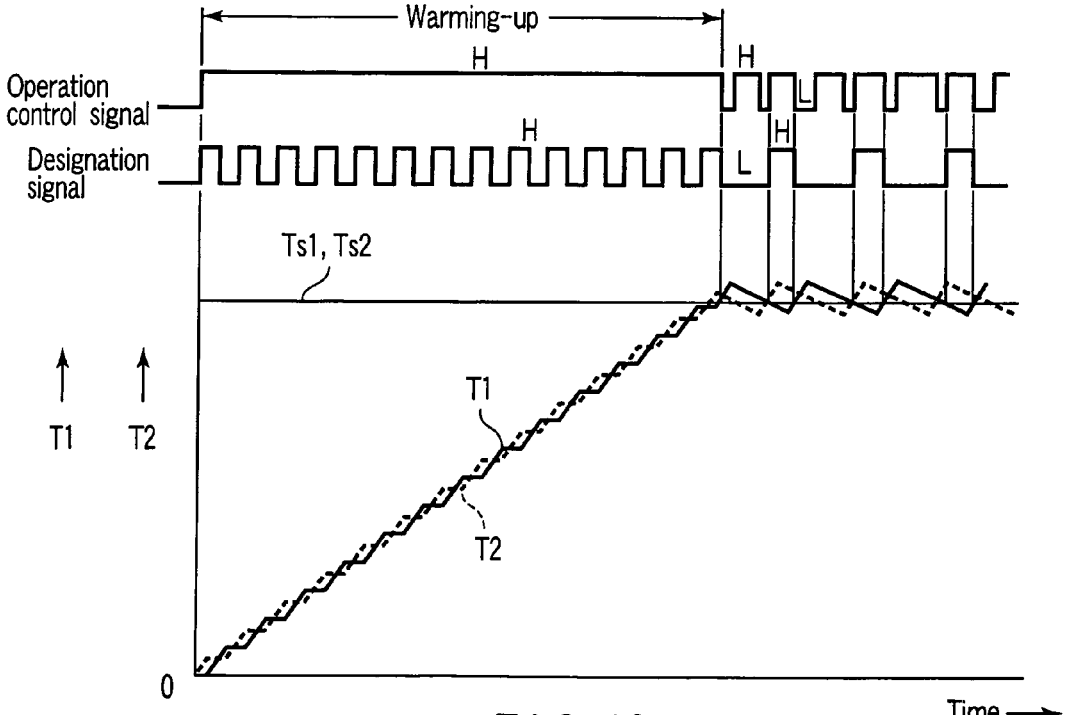
FIG. 10 is a diagram explaining the operation of the signal-processing circuit provided in the third embodiment.

The operation will be explained with reference to FIG. 10.

At first, the temperature T1 detected by the temperature sensor 13 is lower than the set temperature Ts1 (T1<Ts1). The comparing circuit 101 therefore outputs a low-level signal. The temperature T2 detected by the temperature sensor 14 is also lower than the set temperature Ts2 (T2<Ts2). The comparing circuit 102 therefore outputs a low-level signal.

If the outputs of the comparing circuits 101 and 102 are low-level signals, the output (operation control signal) of the gate circuit 103 is at high level. The coils 4, 5 and 6 are therefore allowed to operate.

If the outputs of both comparing circuits 101 and 102 are low-level signals, the output of the gate circuit 106 becomes a high-level signal. When the output of the gate circuit 106 is a high-level signal, the selecting circuit 107 selects and outputs the output signal of the comparing circuit 108. (This output signal is a high-level signal or a low-level signal, depending on the result of comparing the temperatures T1 and T2, both detected.) If this signal is a high-level signal, it designates the operation of the center coil 4. If the signal is a low-level signal, it designates the operation of the side coils 5 and 6.

The temperature T1 of the almost middle part of the heat roller 2 may be higher than the temperature T2 of the end parts of the heat roller 2. In this case, the output of the comparing circuit 108 becomes a low-level signal, designating the operation of the side coils 5 and 6 that are located in the parts that are at a low temperature. When the operation of the side coils 5 and 6 is thus designated, the high-frequency wave generating circuit 71 is driven, operating the side coils 5 and 6. As a result, both end parts of the heat roller 2 are heated and their temperature rises.

The temperature T2 of the end parts of the heat roller 2 may be higher than the temperature T1 of the almost middle part of the heat roller 2. If this is the case, the output of the comparing circuit 108 becomes a high-level signal, designating the operation of the center coil 4 that is located in the part that is at a low temperature. When the operation of the center coil 4 thus designated, the high-frequency wave generating circuit 61 is driven, operating the center coil 4. The almost middle part of the heat roller 2 is thereby heated and its temperature rises.

That is, any coil located in a part of the roller 2 that is at a low temperature is preferentially operated.

The center coil 4 and the side coils 5 and 6 are thus alternately operated. The almost middle part and end parts of the heat roller 2 are heated and their temperatures rise.

When the temperature T1 detected by the temperature sensor 13 rises to or above the set temperature Ts1 (T1≧Ts1), the output of the comparing circuit 101 changes to a high-level signal. When the temperature T2 detected by the temperature sensor 14 rises to or above the set temperature Ts2 (T2≧Ts2), the output of the comparing circuit 101 changes to a high-level signal. When the outputs of both comparing circuit 101 and 102 become a high-level signal, the output (operation control signal)of the gate circuit 103 becomes a low-level signal and inhibits the coils 4, 5 and 6 from operating. That is, all coils 4, 5 and 6 stop operating, regardless of the output (designation signal)of the selecting circuit 107. Thus, the warming-up is terminated.

After the warming-up is terminated, the temperature T1 detected by the temperature sensor 13 falls below the set temperature Ts1 (T1<Ts1). Then, the output of the comparing circuit 101 becomes a low-level signal. As a result, the output (operation control signal) of the gate circuit 103 becomes a high-level signal. This allows the coils 4, 5 and 6 to operate. If the temperature T2 detected by the temperature sensor 14 remains equal to or higher than the set temperature Ts2 (T1≧Ts2), the output of the comparing circuit 102 is a high-level signal. The output (designation signal) of the gate circuit 106 therefore remains at low level. The selecting circuit 107 therefore selects and outputs the high-level signal that is the output of the comparing circuit 102. Thus selected and output, this high-level signal designates the operation of the center coil 4.

The coils 4, 5 and 6 are allowed to operate, and the operation of the center coil 4 is designated. The center coil 4 therefore starts operating.

Thereafter, the temperature T2 detected by the temperature sensor 14 falls below the set temperature Ts2 (T1<Ts2). Then, the output of the comparing circuit 102 becomes a low-level signal. The selecting circuit 107 selects and outputs this low-level signal as a designation signal. Thus, the operation of the side coils 5 and 6 is designated.

The coils 4, 5 and 6 are allowed to operate, and the operation of the side coils 5 and 6 is designated. Hence, the side coils 5 and 6 start operating.

The center coil 4 and the side coils 5 and 6 are thus alternately operated. The temperature T1 of the almost middle part of the heat roller 2 and the temperature T2 of the end parts thereof are thereby maintained at the set temperatures Ts1 and Ts2, respectively.

As indicated above, the signal-processing circuit 94 that has a simple structure and is inexpensive generates an operation control signal and a designation signal in accordance with the temperatures detected by the temperature sensors 13 and 14. The operation control signal and the designation signal, both output from the signal-processing circuit 94, selectively drive the center coil 4 and the side coils 5 and 6. This easily accomplishes the alternate driving of the center coil 4 and the side coils 5 and 6 and the temperature control of the heat roller 2, without imposing a load on the control achieved by the CPU 90 and the like. The use of the simple and inexpensive signal-processing circuit 94 can reduce the cost.

As described above, the set temperatures Ts1 and Ts2 have the same value. Instead, the temperatures Ts1 and Ts2 may be set to different values, depending on the size of the paper sheet 20. Even if the set temperatures Ts1 and Ts2 are different, the temperature can be uniformly distributed in the heat roller 2 in the axial direction thereof, regardless of the thermal capacity of the heat roller 2 or the size of the paper sheet 20.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus, comprising:

a heating member which rotates;

a first coil which performs induction heating at a part of the heating member, which is a first area in a direction that intersects at right angles with a direction in which the heating member rotates;

a second coil which performs induction heating at a second area of the heating member, which extends in the direction that intersects at right angles with the direction in which the heating member rotates;

a first temperature sensor which detects a temperature T1 of the part of the heating member, which is the first area in the direction that intersects at right angles with the direction in which the heating member rotates;

a second temperature sensor which detects a temperature T2 of the second area of the heating member, which extends in the direction that intersects at right angles with the direction in which the heating member rotates;

a signal-processing circuit which generates a signal for allowing each of the coils to operate or inhibiting the same from operating, in accordance with the temperatures detected by the temperature sensors, and which generates a signal for designating operation of the first coil or second coil;

a drive circuit which selectively drives each of the coils, in accordance with the signals generated by the signal-processing circuit;

a first high-frequency wave generating circuit which outputs a high-frequency current for causing the first coil to generate a high-frequency magnetic field for induction heating; and a second high-freciuency wave generating circuit which outputs a high-frequency current for causing the second coil to generate a high-frequency magnetic field for induction heating.

2. The apparatus according to claim 1, wherein the signal-processing circuit comprises:

a first comparing circuit which compares the temperature T1 detected by the first temperature sensor with a set temperature Ts that has been preset;

a second comparing circuit which compares the temperature T2 detected by the second temperature sensor with the set temperature Ts;

a first gate circuit which outputs a signal for allowing or inhibiting each of the coils to operate or from operating, in accordance with outputs of the comparing circuits; and a second gate circuit which outputs a signal for designating the first coil or a signal for designating the second coil, in accordance with an output of the output of the first comparing circuit.

3. The apparatus according to claim 1, wherein the signal-processing circuit comprises:

a first comparing circuit which compares the temperature T1 detected by the first temperature sensor with a set temperature Ts that has been preset, and which outputs a low-level signal when $T1<Ts$ and a high-level signal when $T1 \geqq Ts$ a second comparing circuit which compares the temperature T2 detected by the second temperature sensor with the set temperature Ts and which outputs a low-level signal when $T2<Ts$ and a high-level signal when $T2 \geqq Ts$ a first gate circuit which outputs a high-level signal for allowing each of the coils to operate, when at least one of the outputs of the comparing circuits is a low-level signal, and which outputs a low-level signal for inhibiting each of the coils from operating, when both outputs of the comparing circuits are high-level signals; and a second gate circuit which outputs a high-level signal for designating operation the first coil, when the output of the first comparing circuit is a high-level signal, and which outputs a low-level signal for designating operation of the second coil, when the output of the first comparing circuit is a low-level signal.

4. The apparatus according to claim 1, wherein the signal-processing circuit comprises:

a first comparing circuit which compares the temperature T1 detected by the first temperature sensor with a set temperature Ts that has been preset;

a second comparing circuit which compares the temperature T2 detected by the second temperature sensor with the set temperature Ts;

a first gate circuit which outputs a signal for allowing or inhibiting each of the coils to operate or from operating, in accordance with outputs of the comparing circuits;

an oscillating circuit which generates a clock signal;

a second gate circuit which outputs a signal for selecting an output signal of the oscillating circuit or a signal for selecting an output signal of the second comparing circuit, in accordance with outputs of the comparing circuits; and a selecting circuit which selects one of the outputs of the oscillating circuit and second comparing circuit in accordance with the output of the second gate circuit and which outputs the signal selected as a signal for designating operation of one of the coils.

5. The apparatus according to claim 1, wherein the signal-processing circuit comprises:

a first comparing circuit which compares the temperature T1 detected by the first temperature sensor with a set temperature Ts that has been preset, and which outputs a low-level signal when $T1<Ts$ and a high-level signal when $T1 \geqq Ts$ a second comparing circuit which compares the temperature T2 detected by the second temperature sensor with the set temperature Ts and which outputs a low-level signal when $T2<Ts$ and a high-level signal when $T2 \geqq Ts$ a first gate circuit which outputs a high-level signal for allowing each of the coils to operate, when at least one of the outputs of the comparing circuits is a low-level signal, and which outputs a low-level signal for inhibiting each of the coils from operating, when both outputs of the comparing circuits are high-level signals;

an oscillating circuit which generates a clock signal;

a second gate circuit which outputs a high-level signal for selecting the output signal of the oscillating circuit, when both outputs of the comparing circuits are low-level signal, and which outputs a low-level signal for selecting the output signal of the second comparing circuit designating operation of the second coil, when the outputs of both comparing circuits are not a low-level signal; and a selecting circuit which selects an output signal of the oscillating circuit, when the output of the first gate circuit is a high-level signal, which selects an output of the second comparing circuit when the output of the second gate circuit is a low-level signal, and which outputs the signal selected, as a signal for designating operation of one of the coils.

6. The apparatus according to claim 1, wherein the signal-processing circuit comprises:

a first comparing circuit which compares the temperature T1 detected by the first temperature sensor with a set temperature Ts that has been preset;

a second comparing circuit which compares the temperature T2 detected by the second temperature sensor with the set temperature Ts;

a first gate circuit which outputs a signal for allowing each of the coils to operate and a signal inhibiting each of the coils from operating, in accordance with outputs of the comparing circuits;

a third comparing circuit which compares the temperature T1 detected by the first temperature sensor with the temperature T2 detected by the second temperature sensor;

a second gate circuit which outputs an signal for selecting an output signal of the third comparing circuit or an output signal of the second comparing circuit, in accordance with outputs of the first and second comparing circuits; and a selecting circuit which selects an output signal of the third comparing circuit or an output signal of the second comparing circuit in accordance with an output of the second gate circuit, and which outputs the signal selected, as a signal for designating operation of one of the coils.

7. The apparatus according to claim 1, wherein the signal-processing circuit comprises:

a first comparing circuit which compares the temperature T1 detected by the first temperature sensor with a set temperature Ts that has been preset, and which outputs a low-level signal when $T1<Ts$ and a high-level signal when $T1 \geqq Ts$ a second comparing circuit which compares the temperature T2 detected by the second temperature sensor with the set temperature Ts and which outputs a low-level signal when $T2<Ts$ and a high-level signal when $T2 \geqq Ts$ a third comparing circuit which compares the temperature T1 detected by the first temperature sensor with the temperature T2 detected by the second temperature sensor and which outputs a high-level signal and a low-level signal in accordance with results of comparison;

a first gate circuit which outputs a high-level signal for allowing each of the coils to operate, when at least one of the outputs of the comparing circuits is a low-level signal, and which outputs a low-level signal for inhibiting each of the coils from operating, when both outputs of the comparing circuits are high-level signals;

a second gate circuit which outputs a high-level signal for selecting an output signal of the third comparing circuit, when both outputs of the first and second comparing circuits are low-level signals, and which outputs a low-level signal for selecting an output signal of the second comparing circuit, when both outputs of the first and second comparing circuit are not low-level signals; and a selecting circuit which selects the output signal of the third comparing circuit when an output of the second gate circuit is a high-level signal, which selects the output signal of the second comparing circuit when an output of the second gate circuit is a low-level signal, and which outputs the signal selected, as a signal for designating operation of one of the coils.

8. The apparatus according to claim 1, wherein the drive circuit selectively drives each high-frequency wave generating circuit in accordance with the signals generated by the signal-processing circuit.

9. The apparatus according to claim 1, further comprising:

a pressing member which contacts the heating member, rotates together with the heating member and applies a pressure to an object, thereby to fix an image on the object nipped between the heating member and the pressing member.

10. A fixing apparatus, comprising:

a heat roller;

a first coil which performs induction heating at a part of the heat roller, which is a first area in an axial direction of the heat roller;

a second coil which performs induction heating at a second area of the heat roller, which extends in the direction that intersects at right angles with the axial direction in which the heat roller;

a first temperature sensor which detects a temperature T1 of the part of the heat roller, which is the first area in the axial direction of the heat roller;

a second temperature sensor which detects a temperature T2 of the second area of the heat roller, which extends in the axial direction of the heat roller;

a signal-processing circuit which generates a signal for allowing each of the coils to operate or inhibiting the same from operating, in accordance with the temperatures detected by the temperature sensors, and which generates a signal for selectively operating each of the coils;

a drive circuit which selectively drives each of the coils, in accordance with the signals generated by the signal-processing circuit;

a first high-frequency wave generating circuit which outputs a high-frequency current for causing the first coil to generate a high-frequency magnetic field for induction heating; and a second high-frequency wave generating circuit which outputs a high-frequency current for causing the second coil to generate a high-frequency magnetic field for induction heating.

11. The apparatus according to claim 10, wherein the signal-processing circuit comprises:

a first comparing circuit which compares the temperature T1 detected by the first temperature sensor with a set temperature Ts that has been preset;

a second comparing circuit which compares the temperature T2 detected by the second temperature sensor with the set temperature Ts;

a first gate circuit which outputs a signal for allowing or inhibiting each of the coils to operate or from operating, in accordance with outputs of the comparing circuits; and a second gate circuit which outputs a signal for designating operation of the first coil or a signal for designating operation of the second coil, in accordance with an output of the output of the first comparing circuit.

12. The apparatus according to claim 10, wherein the signal-processing circuit comprises:

a first comparing circuit which compares the temperature T1 detected by the first temperature sensor with a set temperature Ts that has been preset, and which outputs a low-level signal when $T1<Ts$ and a high-level signal when $T1 \geqq Ts$ a second comparing circuit which compares the temperature T2 detected by the second temperature sensor with the set temperature Ts and which outputs a low-level signal when T2<Ts and a high-level signal when T2≧Ts;

a first gate circuit which outputs a high-level signal for allowing each of the coils to operate, when at least one of the outputs of the comparing circuits is a low-level signal, and which outputs a low-level signal for inhibiting each of the coils from operating, when both outputs of the comparing circuits are high-level signals; and a second gate circuit which outputs a high-level signal for designating operation the first coil, when the output of the first comparing circuit is a high-level signal, and which outputs a low-level signal for designating operation of the second coil, when the output of the first comparing circuit is a low-level signal.

13. The apparatus according to claim 10, wherein the signal-processing circuit comprises:

a first comparing circuit which compares the temperature T1 detected by the first temperature sensor with a set temperature Ts that has been preset;

a second comparing circuit which compares the temperature T2 detected by the second temperature sensor with the set temperature Ts;

a first gate circuit which outputs a signal for allowing or inhibiting each of the coils to operate or from operating, in accordance with outputs of the comparing circuits;

an oscillating circuit which generates a clock signal;

a second gate circuit which outputs a signal for selecting an output signal of the oscillating circuit or a signal for selecting an output signal of the second comparing circuit, in accordance with outputs of the comparing circuits; and a selecting circuit which selects one of the outputs of the oscillating circuit and second comparing circuit in accordance with the output of the second gate circuit and which outputs the signal selected as a signal for designating operation of one of the coils.

14. The apparatus according to claim 10, wherein the signal-processing circuit comprises:

a first comparing circuit which compares the temperature T1 detected by the first temperature sensor with a set temperature Ts that has been preset, and which outputs a low-level signal when T1<Ts and a high-level signal when T1≧Ts a second comparing circuit which compares the temperature T2 detected by the second temperature sensor with the set temperature Ts and which outputs a low-level signal when T2<Ts and a high-level signal when T2≧Ts;

a first gate circuit which outputs a high-level signal for allowing each of the coils to operate, when at least one of the outputs of the comparing circuits is a low-level signal, and which outputs a low-level signal for inhibiting each of the coils from operating, when both outputs of the comparing circuits are high-level signals;

an oscillating circuit which generates a clock signal;

a second gate circuit which outputs a high-level signal for selecting an output signal of the oscillating circuit, when both outputs of the comparing circuits are low-level signal, and which outputs a low-level signal for selecting the output signal of the second comparing circuit designating operation of the second coil, when the outputs of both comparing circuits are not a low-level signal; and a selecting circuit which selects an output signal of the oscillating circuit, when an output of the first gate circuit is a high-level signal, which selects an output of the second comparing circuit when an output of the second gate circuit is a low-level signal, and which outputs the signal selected, as a signal for designating operation of one of the coils.

15. The apparatus according to claim 10, wherein the signal-processing circuit comprises:

a first comparing circuit which compares the temperature T1 detected by the first temperature sensor with a set temperature Ts that has been preset;

a second comparing circuit which compares the temperature T2 detected by the second temperature sensor with the set temperature Ts;

a first gate circuit which outputs a signal for allowing each of the coils to operate and a signal inhibiting each of the coils from operating, in accordance with outputs of the comparing circuits;

a third comparing circuit which compares the temperature T1 detected by the first temperature sensor with the temperature T2 detected by the second temperature sensor;

a second gate circuit which outputs an signal for selecting an output signal of the third comparing circuit or an output signal of the second comparing circuit, in accordance with outputs of the first and second comparing circuits; and a selecting circuit which selects an output signal of the third comparing circuit or an output signal of the second comparing circuit in accordance with an output of the second gate circuit, and which outputs the signal selected, as a signal for designating operation of one of the coils.

16. The apparatus according to claim 10, wherein the signal-processing circuit comprises:

a first comparing circuit which compares the temperature T1 detected by the first temperature sensor with a set temperature Ts that has been preset, and which outputs a low-level signal when T1<Ts and a high-level signal when T1≧Ts a second comparing circuit which compares the temperature T2 detected by the second temperature sensor with the set temperature Ts and which outputs a low-level signal when T2<Ts and a high-level signal when T2≧Ts;

a third comparing circuit which compares the temperature T1 detected by the first temperature sensor with the temperature T2 detected by the second temperature sensor and which outputs a high-level signal and a low-level signal in accordance with results of comparison;

a first gate circuit which outputs a high-level signal for allowing each of the coils to operate, when at least one of the outputs of the comparing circuits is a low-level signal, and which outputs a low-level signal for inhibiting each of the coils from operating, when both outputs of the comparing circuits are high-level signals;

a second gate circuit which outputs a high-level signal for selecting an output signal of the third comparing circuit, when both outputs of the first and second comparing circuits are low-level signals, and which outputs a low-level signal for selecting an output signal of the second comparing circuit, when both outputs of the first and second comparing circuits are not low-level signals; and a selecting circuit which selects the output signal of the third comparing circuit when an output of the second gate circuit is a high-level signal, which selects the output signal of the second comparing circuit when an output of the second gate circuit is a low-level signal, and which outputs the signal selected, as a signal for designating operation of one of the coils.

17. The apparatus according to claim 10, wherein the drive circuit selectively drives each high-frequency wave generating circuit in accordance with the signals generated by the signal-processing circuit.

* * * * *